United States Patent [19]

Nutt et al.

[11] 4,058,669

[45] Nov. 15, 1977

[54] TRANSMISSION PATH BETWEEN NEARBY TELEPHONE CENTRAL OFFICES

[75] Inventors: Wendell Glenn Nutt; George Harry Webster, both of Dunwoody, Ga.

[73] Assignee: Bell Telephone Laboratories, Incorporated, Murray Hill, N.J.

[21] Appl. No.: 637,066

[22] Filed: Dec. 2, 1975

[51] Int. Cl.[2] ..... H01B 11/04

[52] U.S. Cl. ..... 174/34; 174/27; 174/110 F; 174/110 PM

[58] Field of Search ..... 174/34, 27, 110 F, 110 PM, 174/113 R, 36, 103

[56] References Cited

U.S. PATENT DOCUMENTS

| | | | |
|---|---|---|---|
| 3,040,278 | 6/1962 | Griemsmann | 174/110 F X |
| 3,968,463 | 7/1976 | Boysen | 174/110 F X |

FOREIGN PATENT DOCUMENTS

| | | | |
|---|---|---|---|
| 638,002 | 3/1962 | Canada | 174/110 F |
| 2,240,199 | 2/1974 | Germany | 174/34 |
| 1,147,281 | 4/1963 | Germany | 174/110 F |

*Primary Examiner*—Arthur T. Grimley
*Attorney, Agent, or Firm*—Charles E. Graves

[57] ABSTRACT

A multipair telephone cable especially designed to carry interoffice traffic consists of copper conductors insulated with expanded plastic with or without a solid plastic skin. The copper gauge size, insulation expansion factor and dielectric diameter are uniquely designed to consume a minimum of cable cross-section area while permitting use of the cable to provide voice frequency circuits in a manner comparable to normal; 24-gauge cable as well as to provide carrier frequency circuits operating in the range of from about 100 kHz to 8.0 MHz comparably to normal 22-gauge cable. The cable includes pairs twisted according to a constant twist frequency spacing concept.

10 Claims, 6 Drawing Figures

TRANSMISSION PATH BETWEEN NEARBY TELEPHONE CENTRAL OFFICES

FIELD OF THE INVENTION

This invention relates to telephonic transmission systems, and more exactly to such systems installed between central offices in large cities, known as trunk circuits.

BACKGROUND OF THE INVENTION

Most of the transmission paths between central offices in larger cities in this country is by way of short-haul multipair cable. Such multipair cable trunks typically consist of 24-gauge pulp-insulated cable for voice frequency paths, and 22-gauge pulp-insulated conductors for carrier circuits. The cables typically are placed underground in ducts. Pulp-insulated conductor cable has been the industry's standard for such short-haul routes in the past because, inter alia, of its close packing providing an optimally large number of conductor pairs per unit cross section of cable.

Once installed, these short-haul cables at first carry mainly voice frequency signals. As the trunk traffic grows, and each pair is placed into interoffice use, it is economical to defer duct construction and cable placement by installing on the existing cable pairs multiplexing systems known as carrier. The pattern of utilizing a cable first for voice frequency circuit pairs and later—as more channels are needed—adding carrier circuits to the pairs, has proven highly cost-efficient for some situations. This efficiency was and is particularly true in the case of T1 carrier, a now-widely used multiplexing system which is described in *The Bell System Technical Journal,* Vol. XLIV, No. 7. This article to the extent relevant is hereby incorporated by reference.

The T1 carrier system was specifically designed to operate with standard 83 nanofarads per mile, 22-gauge wood pulp insulated conductor exchange area cable with a nominal repeater spacing of 6,000 feet and a repeater gain of 35 dB. When installed, the system converts each two pairs to 24 voice-frequency channels. However, with the steady growth of interoffice short-haul trunks there is still further incentive to improve upon the design of short-haul transmission systems.

One significant further factor in the design of a modern cost-efficient interoffice short-haul plant is that many offices are connected by a composite of voice frequency signal paths and carrier paths. Existing multipair cable designs are not well adapted, however, to carry such composite traffic.

With the above and other factors in mind, the following are objects of the present invention:

to assure an interoffice trunk transmission system with a wide flexibility to handle both voice and carrier frequency signals;

to provide such a system in which the cable configuration permits the same T1 repeater spacing and gain as the present standard;

to minimize copper usage;

importantly, to maximize pair counter per unit cable cross section for metropolitan conduit utilization efficiency surpassing that obtainable with 22-gauge wood pulp;

to provide such an interoffice transmission system in which the cable component electrically approximates the voice frequency transmission characteristics of 24-gauge pulp cable with or without the present conventional H88 loading, thus to facilitate utilization of existing facilities;

to minimize voice frequency equipment redesign;

for a given pair count in a cable, to achieve a cable design that further minimizes incidence of crosstalk, thus to permit economic use thereon of carrier frequencies yet higher than T1; and overall, to enhance the efficient growth pattern whereby cable pairs may be utilized first for voice circuits and then, as growth demands, converted to T1 carrier transmission.

SUMMARY OF THE INVENTION

In its broad aspect this invention involves the realization that a range of copper conductor diameter exists which, taken together with a specific range of thickness of an expanded insulation yield highly advantageous performance characteristics when used in short-haul trunks.

Specifically, when copper wire diameter is maintained within a range of from about 17 mils to 19½ mils and when total insulation thickness is limited to within a range of 7 to 9 mils, the present T1 repeater gain of 35 dB and the present repeater spacing of 6,000 feet nominal requires no change.

The conductor insulation may consist of an expanded polyolefin of 7–9 mils thickness or, advantageously, although not necessarily, the conductor insulation consists of an interior layer of expanded polyolefin of 5–7 mils thickness, covered by an outer solid skin of polyolefin about 2 mils in thickness.

The invention as broadly stated is particularly advantageous because with but minor equipment or useage modifications it serves existing (mostly 24 gauge) voice frequency circuits; and again with but minor modifications also serves all carrier equipment operating anywhere within the range of about 50–100 kHz to about 8.0 MHz.

Advantageously, to achieve the desired greater capability of transmitting high frequency signals without objectionable high crosstalk, the invention utilizes a pair twist scheme based upon constant twist frequency spacing.

A still further crosstalk-reducing expedient has been realized pursuant to one aspect of this invention, through a cable configuration which consists of several units made up of conductive pairs twisted in accordance with the same constant twist frequency spacing scheme. The multiunit group is stranded of a plurality of such units.

As an added option the operation can produce, if desired, a uniform change in the twist pair lay length of all pairs in the multiunit group when a constant twist frequency spacing scheme is employed. As a result, initially identically formed pair twists in different multiunits may be different.

DETAILED DESCRIPTION OF ILLUSTRATIVE EMBODIMENT

Theoretical Considerations

Figure 1:
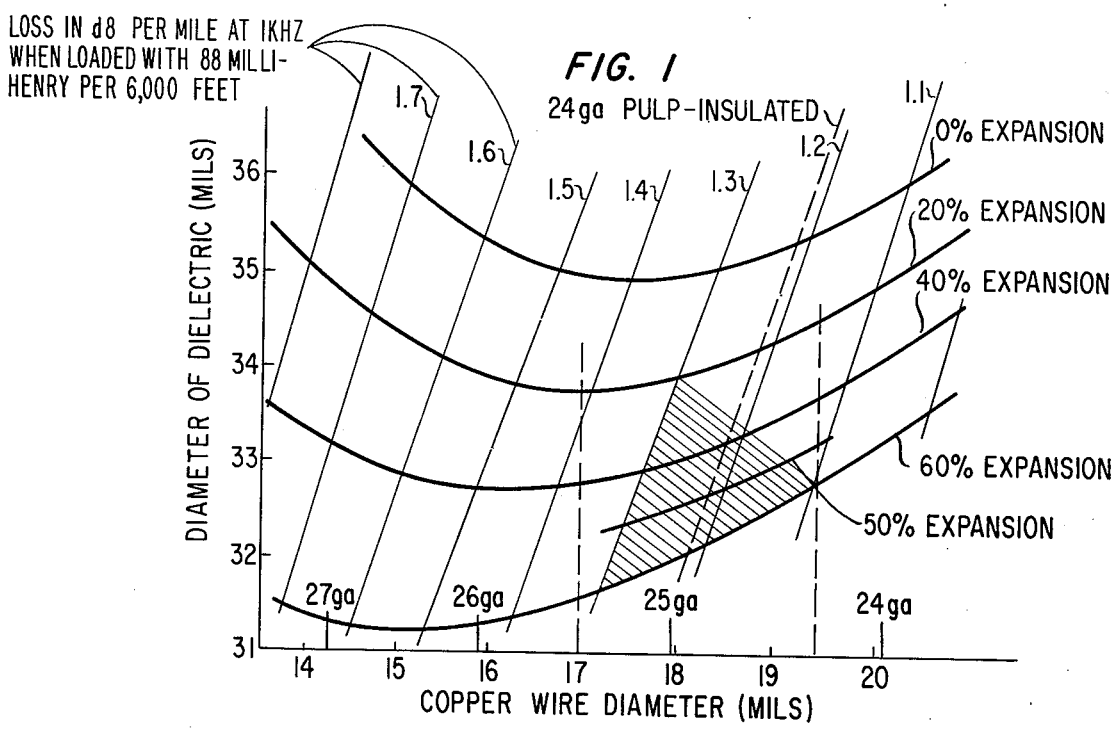
FIG. 1 is a graph illustrating optimum selection criteria for insulation expansion factor, copper wire diameter, and dielectric diameter for multipair cable having characteristics advantageous for voice frequency and T1 carrier systems.

The technical and cost superiority of cable constructed in accordance with the present invention are attributable to analytical considerations summarized below.

Using conventional notation, the VF loss of a pair in a multipair cable is well represented by:

$$\alpha_{VF} = \sqrt{R\omega C}/2 \quad (1)$$

where $\alpha$ is the VF attenuation;

R is the DC resistance of wire;

C is pair mutual capacitance.

R is inversely proportional to the wire's cross-sectional area. For a wire diameter D and at a given frequency:

$$\alpha_{VF} = K_1\sqrt{C}/D \quad (2)$$

where $K_1$ is a constant.

Given an 83 nF/mile cable pair and with the diameter of the insulation held constant while the wire diameter is decreased, the reduction in D will cause the attenuation to tend to rise. But this rise will be offset at least partially by the reduction in C, the mutual capacitance of the pair.

At high frequencies, for example, the 772 kHz Nyquist frequency for the T1 carrier system, pulp insulation has a significant conductance loss which causes its overall attenuation to be about 10% higher than PIC cable, although its space per pair is about 10% less.

At the 772 kHz Nyquist frequency for the T1 carrier system, as well as in a plastic insulated conductor cable where conductance is negligible, an excellent approximation for loss is $$\alpha_{HF} = R/2\sqrt{C}/L \quad (3)$$

where L is the pair mutual inductance.

At this frequency the current is carried predominantly by the outer skin of the wire so that the resistance R is proportional to 1/D. Thus $$\alpha_{HF} = K_2\sqrt{C}/D \cdot \sqrt{1}/L \quad (4)$$

where $K_2$ is a constant.

If now the wire is again reduced in diameter, not only does the decrease in C help compensate for the reduced diameter, exactly as in the VF case, but there is an increase in the HF inductance L to further mitigate its effect. Overall, the HF loss is affected less by the reduction in wire size than is the VF loss.

Percentage changes in the constants of interest for both VF and HF in shrinking wire size from 22 gauge to 26 gauge in PIC pairs can be seen by comparing lines 1 and 2 in Table I. In the table the metamorphosis is continued in line 3 where 40% expanded plastic is substituted for the solid plastic originally assumed, with the objective of further reducing both losses by reducing C. Finally in line 4, because the HF loss has now fallen to less than its initial value, some insulation can be removed and the diameter over dielectric (DOD) can be reduced, to restore it to its initial value.

Table I

| | V.F. $\alpha = \sqrt{\frac{R\omega C}{2}}$ | | | H.F. $\alpha = \frac{R}{2}\sqrt{\frac{C}{L}}$ | | | |
|---|---|---|---|---|---|---|---|
| | R | C | $\alpha$ | R | L | C | $\alpha$ |
| 22 gauge PIC | 100 | 100 | 100 | 100 | 100 | 100 | 100 |
| 26 gauge wire solid insulation | 250 | 67 | 130 | 151 | 146 | 67 | 102 |
| expanded polyethylene insulation | 250 | 55 | 118 | 151 | 146 | 55 | 93 |
| reduced DOD | 250 | 59 | 122 | 153 | 138 | 59 | 100 |
| | 24-Ga. 127 | | | | | | |

STRUCTURE

The above sequence illustrates the realization of a 26-gauge expanded plastic insulated pair design whch matches the HF attenuation of a 22-gauge PIC pair, has a 10% smaller diameter, and a VF loss somewhat less than that of a 24-gauge PIC pair. The material savings in this example are 60% in conductor, 40% in plastic insulation and some 10% in sheathing materials.

The conductor is copper, and the insulation is advantageously high density polyethylene or polypropylene with an effective expansion near 40%. Effective expansion herein denotes a dual expanded construction consisting of a highly (say 45%) expanded layer of natural material with an outer 2-mil skin of pigmented material.

Compared with the nonskinned expanded insulation, the dual insulation has advantages in ruggedness and dielectric strength, and in providing intense standard colors rather than the pastel shades to which the simple expanded insulation is limited. In manufacture, it avoids interaction of pigments on blowing agents; also, entrapment of gas by the skin leads to more efficient blowing.

Comparative diameters and cable H-88 loaded voice frequency losses for a range of cables having the specified attenuation are shown in FIG. 1. The solid lines in FIG. 1 labeled with various percent expansion factors represent cable designs which will perform equivalently to 22-gauge pulp cable with the T1 system. Minimum diameters are achieved with 26- to 27-gauge conductors. However, dc resistance and manufacturing and field handling problems are found to be unfavorably increased below about 17-mils copper conductor diameter. Above about 19½ mils conductor diameter, depending upon the degree of expansion of the polyethylene or polypropylene inner coat, the diameter over dielectric becomes so large that the cross-sectional pair density starts to decrease below its optimum level.

The shaded area of FIG. 1 represents bounds within which, in general, the invention's advantages may be realized. A specific advantageous region for 25-gauge copper wire is seen to exist when the expansion factor is within the range of about 20% to 60%; and within this range the most advantageous combination of attenuation and diameter of dielectric factors is achieved within a range of 35%–50% expansion.

Figure 2:
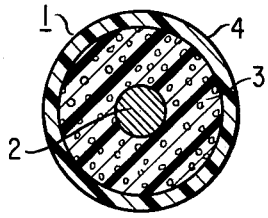
FIG. 2 is a transverse cross-sectional view of a conductor insulated with expanded plastic and an outer solid skin.
Figure 2A:
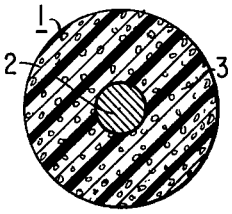
FIG. 2*a* is a transverse cross-sectional view of an alternative conductor insulated only with expanded plastic.

FIG. 2 illustrates a conductor denoted 1 with the dual-layer insulation as described above, and consisting of copper conductor 2, expanded polyethylene inner layer 3 and solid outer polyethylene layer 4. FIG. 2A illustrates a conductor having only the layer 3 as insulation, which electrically is substantially the equivalent of that of FIG. 2.

Figure 3:
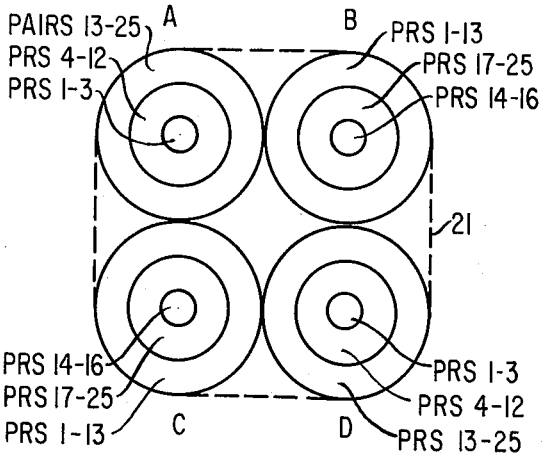
FIG. 3 is a transverse schematic diagram of a cable unit consisting of a cable multiunit of four units of 25 pair each, arranged for good crosstalk reduction.

Advantageously, multipair cables are constructed using the conductor structure of FIG. 2, by making up units of such structures. Each unit consists of a center, an inner layer and an outer layer of conductor pairs. One satisfactory assembly has a three-pair center, a 9-pair middle layer and a 13-pair outer layer. In FIG. 3 four such units are illustrated, denoted A, B, C, and D. Assembled, the units are a "multiunit" denoted 20 and held in place with a binder 21.

Maintaining separation of pairs with like twists is important in multipair cables for achieving good crosstalk performance. In the present invention, this may be achieved by oscillating the layers of each unit with respect to one other during stranding. Oscillation of layers assures that the assigned pair positions and separations are realized. The technique calls for maintaining the center pairs in a neutral or fixed angular position while rotating all pairs of the middle and outer layers back and forth each through an angle of about 180°. The rotation is 180° out of phase, and completes one oscillation cycle each 50 feet.

Of additional advantage where desired is the inversion of alternate units to ensure still further separation of like pair twists in adjacent units. Thus, as shown in FIG. 3, the alternate units A and C have their last thirteen pairs contained in the outer layer, opposite to the pair placement of units B and D where the first 13 are in the outer layer. Only pair 13 appears in the outer layer of each adjacent unit. It is arranged that pair 13 have the shortest pair twist realizing superior crosstalk performance.

Figure 4:
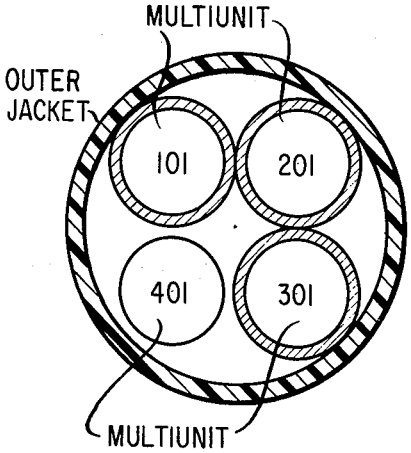
FIG. 4 is a cross-sectional schematic diagram of an interoffice trunk cable using multiunits made by the present invention.

Mutiunits are assembled as a cable core in the manner shown in FIG. 4. The multiunits, denoted 101, 201, 301, 401 may be shielded as with the sealed seam of multiunit 101. One of the multiunits, e.g., 401, need not be shielded if the other three are. The shield advantageously may be of 4-mil aluminum coated on each side with 2 mils of a thermoplastic such as a polyethylene acrylic acid copolymer. Shields for multiunits 201 and 301 may be simple overlapped, nonsealed seams, held in place with a binding (not shown).

Figure 5:
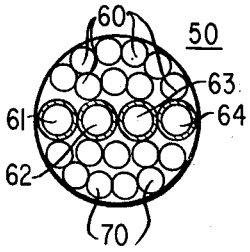
FIG. 5 substantially illustrates a cable and unit shielding configuration.

An alternate cable core shown in FIG. 5 is a multiunit cable core 50 consisting of two basic groups of units designated 60, 70 which are not individually shielded. The groups 60, 70 are electrically separated by individually shielded units 61, 62, 63, 64 disposed along a diameter of the core 50. Thus, the shielding around the respective units 61–64 serves also as a shield between any two conductor pair paths on opposite sides of the units 61–64. Moreover, very substantial shielding exists between the widest-separated units 61 and 64. Respective pairs within these units can thus be used to carry T2 transmissions.

TWIST FREQUENCY PAIR TWIST SPACING

A significant added advantage of the present invention is the employment of constant twist frequency spacing spectrum for the pair twist plan of the pairs in each unit. Pair twists and pair separations are the principal parameters controlled in multipair cable design and manufacture. The strategy is to have pairs that are in close physical proximity to be well separated in twist characteristic.

The practical range of pair twists is limited. Long twists may permit the wires of a pair occasionally to separate from each other and consequently such pairs tend to be strong radiators and/or sensitive receivers of crosstalk. They are also subject to untwisting at splices which can result in a type of splicing error called split pairs in which a wire of one pair is mistaken for that of another pair and two pairs thereby become useless. Short twists, on the other hand, are expensive to produce and require more cross-sectional area in the cable because they will not nest well with other pairs.

Within a limited range of pair twists and taking into account the control of twist separation, it has been found that twist frequency more accurately measures twist separation than does the customarily used parameter, twist length. Twist frequency spacing provides a crowding or close spacing of the high twist frequencies but, advantageously wide spacing of the low twist frequencies.

Twist frequency (TF) has the dimension $(\text{length})^{-1}$ whereas the dimension of twist length (TL) is, of course, length. A TL of 2.0 inches, for example, is the same as a TF of 0.5 twist/inch; and a TL of 5.0 inches is the same as a TF of 0.2 twist/inch.

The twist frequency spacing can be based upon a precession length scheme of from 20 to 51 twists per 90 inches cable length. The range of 20–51 twists is selected to obtain the desired number of discernibly different twists, and yet have practical shortest and longest twists. A further feature is that differences in twist frequency have been randomized for pairs that are proximate. For example, pairs 1, 2, and 3 have twist frequencies of 50, 40, and 29 respectively which give rise to twist frequency differences of 10, 11 and 21. Had the twist frequencies 50, 40 and 30 been assigned, the twist frequency differences would have been 10, 10 and 20. Systematic differences in twist frequency have proved to perform poorly.

The 25-pair unit using the above-noted twist frequency scheme may advantageously have a geometry shown in FIG. 3. Twist frequency values are assigned to the respective pairs pursuant to Table II below.

Table II

| Pair Seq. | Pair Twist Freq. (Twists/90") | Pair Seq. | Pair Twist Freq. (Twists/90") |
|---|---|---|---|
| 1 | 50 | 13 | 51 |
| 2 | 40 | 14 | 31 |
| 3 | 29 | 15 | 41 |
| 4 | 45 | 16 | 20 |
| 5 | 33 | 17 | 49 |
| 6 | 24 | 18 | 39 |
| 7 | 43 | 19 | 28 |
| 8 | 34 | 20 | 47 |
| 9 | 23 | 21 | 38 |
| 10 | 44 | 22 | 27 |
| 11 | 35 | 23 | 48 |
| 12 | 22 | 24 | 37 |
| | | 25 | 26 |

Advantageously, pursuant to a further aspect of the invention, pair-to-pair variations in electrical characteristics are minimized by color coding only the skin of the dual expanded insulation; and by using a natural foamed center or layer which has no pigmentation. This avoids interaction of pigments with blowing agents; and keeps the pigments at a distance from the wire which is desirable because the pigments are lossy dielectrics.

The spirit of the invention is embraced in the scope of the claims to follow.

What is claimed is:

1. A telecommunication multipair cable comprising: one or more units each comprising a plurality of insulated conductors arranged in twisted pairs, each conductor consisting of a copper wire having an insulative dielectric layer comprising a first polyolefin coat expanded with an inert gas, and thereover, a second coat of high density polyethylene, with said first coat constituting the major fraction of the thickness of said dielectric layer, CHARACTERIZED IN THAT:

a. each said copper wire has a diameter of from essentially 17 mils to 19½ mils;

b. the outside diameter of said dielectric layer is in a range of from approximately 31.7 mils to 35.5 mils;

c. and wherein said first coat is expanded by an amount ranging from 20 percent to 60 percent.

2. The cable of claim 1, wherein the copper wire diameter is approximately 17.9 mils, equivalent to 25 gauge, and wherein said first coat expansion is in the range of substantially 40% to 50%.

3. The cable of claim 1, wherein each unit consists of a center assembly of pairs surrounded by a middle layer of pairs and, thereover, an outer layer of further pairs, and wherein the conductors of each separate pair of each said unit are twisted according to a twist frequency spacing plan.

4. The cable of claim 3, wherein the number of pairs in each unit is substantially twenty-five and wherein in the twist frequency spacing plan, the spacing difference is substantially one twist per 90 inches and the twist frequency range is substantially between 20 and 51 twists per 90 inches.

5. The cable of claim 4 wherein plural units are arranged in a cable core in a square pattern and wherein the inner and outer layers of conductor pairs of alternate units in either direction are inverted.

6. The cable of claim 3, wherein the middle and outer layers of each said unit are oscillated.

7. The cable of claim 6, wherein plural units each consisting of substantially the same number of conductor pairs are each separately shielded within a metal envelope.

8. The cable of claim 6, wherein plural units each consisting of substantially the same number of conductor pairs are assembled as a cable core, and the center ones of such units are each separately shielded in a metal envelope.

9. The cable of claim 3, wherein said second coat includes color pigments to provide color codes to respective ones of said pairs, and said first coat is noncolored.

10. A telecommunications multipair cable comprising one or more units each comprising a plurality of insulated conductors twisted in pairs, each conductor comprising a copper wire having an insulative dielectric layer of polyolefin expanded with an inert gas, CHARACTERIZED IN THAT:

a. each said copper wire has a diameter of from substantially 17 mils to 19½ mils;

b. the outside diameter of said dielectric layer is in a range of from approximately 31.7 mils to 35.5 mils; and c. the dielectric layer is expanded by an amount ranging from 20 percent to 60 percent.

* * * * *

UNITED STATES PATENT AND TRADEMARK OFFICE

CERTIFICATE OF CORRECTION

PATENT NO. : 4,058,669
DATED : Nov. 15, 1977
INVENTOR(S) : Wendell G. Nutt and George H. Webster It is certified that error appears in the above-identified patent and that said Letters Patent are hereby corrected as shown below:

In the Abstract, line 8, "normal;" should read --normal--.

Column 8, line 1, "frequency range" should read --frequency spacing range--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*